United States Patent [19]

Lanner

[11] Patent Number: 4,526,218

[45] Date of Patent: Jul. 2, 1985

[54] PROFILE RAIL FOR THE FASTENING OF FLEXIBLE SHEET-LIKE STRUCTURES

[75] Inventor: Helmut F. Lanner, Bondstorpsvägen 11, S-567 00, Vaggeryd, Sweden

[73] Assignee: Conny Sjolin, Vaggeryd, Sweden

[21] Appl. No.: 364,457

[22] Filed: Apr. 1, 1982

[30] Foreign Application Priority Data

Apr. 2, 1981 [DE] Fed. Rep. of Germany ... 8109868[U]

[51] Int. Cl.[3] ..... E06B 3/30

[52] U.S. Cl. ..... 160/374.1

[58] Field of Search ..... 160/398, 404, 374.1

[56] References Cited

U.S. PATENT DOCUMENTS

| | | | |
|---|---|---|---|
| 2,148,848 | 2/1939 | Wiley | 160/404 |
| 2,546,050 | 3/1951 | Weever et al. | 160/404 |
| 3,308,598 | 3/1967 | Wilson | 160/404 |
| 4,151,665 | 5/1979 | Gibby | 160/404 |

FOREIGN PATENT DOCUMENTS

| | | | |
|---|---|---|---|
| 1138818 | 6/1957 | France | 160/404 |

*Primary Examiner*—Peter M. Caun

*Attorney, Agent, or Firm*—Cushman, Darby & Cushman

[57] ABSTRACT

A profile rail for affixing a flexible, sheet-like structure such as a canvas, onto a substantially flat carrier or plate has a substantially U-shaped cross section and two flanges, by means of which it can embrace an edge of the carrier, and comprises a series of teeth or projections. To make possible an easier and more rapid attachment of the canvas to the carrier and subsequent removal of the canvas therefrom the teeth of the profile rail are provided in at least one circumferentially extending line on the outside of the arcuate web of the U-rail.

7 Claims, 8 Drawing Figures

PROFILE RAIL FOR THE FASTENING OF FLEXIBLE SHEET-LIKE STRUCTURES

BACKGROUND OF THE INVENTION

This invention relates to a profile rail for affixing a flexible, sheetlike structure, such as a screen, a canvas or a foil, onto a substantially flat carrier in the shape of a frame or plate, said rail having a substantially U-shaped cross section and teeth or projections and being attachable to said carrier.

An extendible frame for painting canvas is already known which comprises a U-rail of this general kind (U.S. Pat. No. 3,529,653). This rail of the prior art which is intended to be clamped around one shank of an angle iron, around which the canvas is stretched, outside the latter, has the inside of its inner shank provided with teeth which penetrate into the canvas being clamped by means of the rail. The canvas and the rail are clamped on to the shank of the angle iron by means of an outer, stiffer rail which embraces the canvas and the rail and also has a U-shaped cross section. This known structure is comparatively complex since double rails are required. In addition thereto the fastening of the canvas is intricate, since it has to be grasped and held by hand while being fastened. In addition thereto it is almost impossible, on account of the saw-tooth shape of the teeth, to remove the fastened canvas without tearing it.

SUMMARY OF THE INVENTION

The principal object of the invention is to provide an improved rail, by means of which flexible, sheet-like structures, such as canvases or other fabrics, plastic foils or the like, may be easily and rapidly fastened to a frame, a plate or another substantially flat carrier, and subsequently removed therefrom.

This object is attained by providing the rail with a U-shaped cross-section and having teeth provided in a circumferentially extending row on the outside of the arcuate web of the U-shaped rail.

The profile rail is preferably made of flexible material, such as flexible sheet metal or plastic. In the first case the teeth are punched out and bent out of the metal sheet or strip. When the rail consists of plastic, it may be manufactured e.g. by extrusion or injection molding. In the lastmentioned case the rail is formed with an outer ridge which is transformed into teeth by having its portions corresponding to the interspaces between the teeth ground off or removed in another way.

One shank of the rail is preferably narrower than the other shank. The row of teeth, which may extend somewhat in zig-zag, is preferably located nearer one shank, particularly the narrower one, than the other.

In a preferred embodiment the teeth project in a direction which forms an acute angle with the central longitudinal plane of the rail, the points of the teeth being located nearer this plane than their bases.

BRIEF DESCRIPTION OF THE DRAWINGS

In the following some preferred embodiments of the invention will be described as non-limiting examples, reference being made to the annexed drawings.

FIG. 8 is a cross-sectional view corresponding to FIG. 3 and illustrating only the rail, which in this case is made of plastic, on a larger scale.

In FIGS. 1–3 there is shown a plate 1 of cardboard or the like to the edges of which flexible profile rails according to the invention have been pushed on while exerting a clamping action. Two different kinds of rails are shown, i.e. corner rails, which are generally designated 2 and are to be applied to the four corners of the plate 1, and straight margin or edge rails which are generally designated 3 and are each located between two adjacent corner rails 2.

Figure 3:
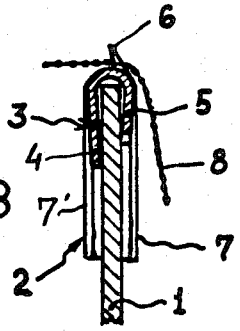
FIG. 3 is a partial sectional view on line III—III in FIG. 2.

As is most clearly shown in FIG. 3 the rail 3 has a substantially U-shaped cross section and comprises a shorter or narrower flange 5 which is located on the front side of the plate 1 as well as a longer or wider flange 4 which is located on the rear side of the plate 1. In the region of the U-web of the rail 3 which is U-shaped as seen in cross section the rail comprises a line or succession of teeth or projections 6 which preferably are located at regular intervals. As is most clearly evident from FIG. 3 the direction of projection of the teeth 6 forms an acute angle with the longitudinal central plane of the rail 3, the bases of the teeth being located nearer the narrower flange 5 than their points. When the rails are made of flexible sheet metal as presumed here, the teeth 6 are punched out and bent out of the metal sheet.

Figure 1:
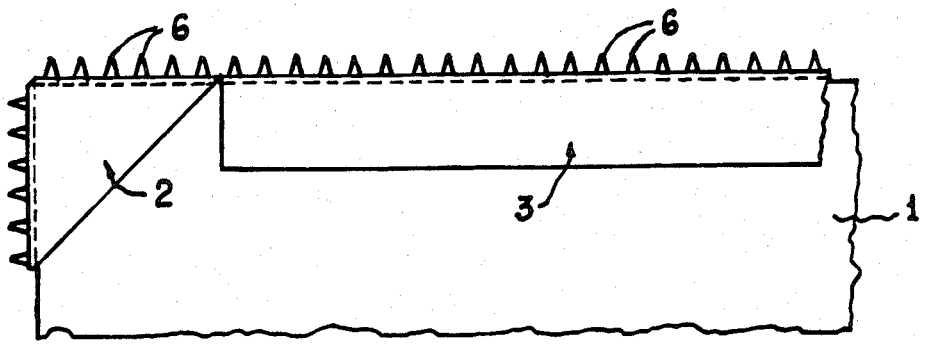
FIG. 1 is a rear plan view of part of a plate to which a painting canvas is to be applied and tightened by means of the rail according to the invention.
Figure 2:
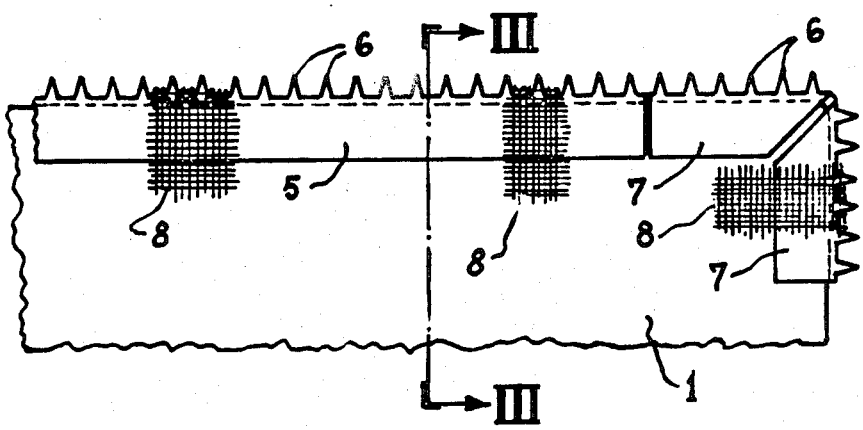
FIG. 2 is a plan view of the plate according to FIG. 1.

Each of the two perpendicular outer edges of the corner rails 2 comprises a line of teeth 6. The two narrower flanges which are located on the front side of the plate 1 are each designated 7, while the two wider flanges which theoretically are located on the rear side of the plate are united into one single, triangular flange 7' in the embodiment according to FIGS. 1–3.

Figure 4:
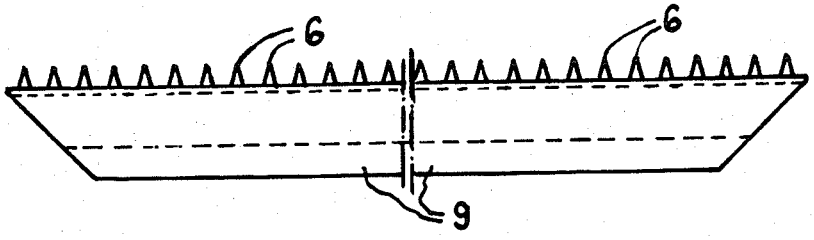
FIG. 4 is a rear plan view of a rail whose two ends are cut obliquely at an angle of 45°.
Figure 5:
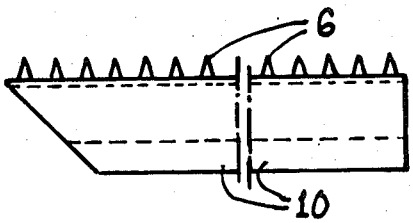
FIGS. 5 and 6 are each a rear plan view of a rail, which corresponds to the left end and the right end, respectively, of the rail according to FIG. 4.
Figure 6:
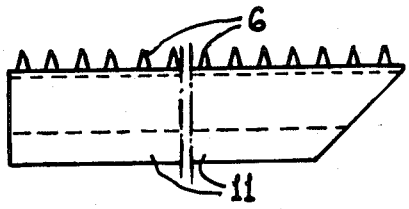

Instead of utilizing corner rails 2 in conjunction with edge rails 3 which at their two ends are cut perpendicularly, it is also possible to provide only one single kind of rails which are illustrated in FIG. 4 in which they are designated 9 and according to which their two ends are cut at an angle of 45° with respect to the longitudinal direction of the rail. One can imagine that the rails 9 are formed of or can be substituted for two corner rails 10 and 11 according to FIGS. 5 and 6, possibly supplemented by one or more edge rails 3 interposed therebetween. It is evident that the rails 10 and 11 together substantially correspond to or form a corner rail 2.

Figure 7:
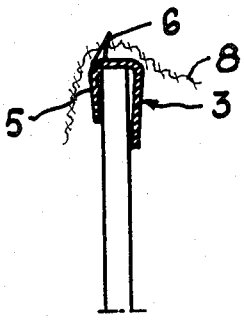
FIG. 7 is a cross sectional view corresponding to FIG. 3 of a modified rail.

FIG. 7 illustrates a rail 3 having a modified cross sectional shape.

When the rails (e.g. 2+3) have been clamped around the edges of the plate 1, which incidentally may be replaced by a frame, the canvas 8 (or a corresponding piece of fabric or a corresponding foil, e.g. of plastic) is attached to the plate simply by having one of its edges bent around the rail(s) of a plate edge, after which the opposite edge of the tensioned canvas is folded around the rail(s) of the opposite plate edge, so that the respective lines of teeth of the two opposite rails engage into the canvas while penetrating it. After that one proceeds to the two remaining edges of the canvas which are manipulated in the same way. The result is clearly evident from FIGS. 2 and 3.

The rails are preferably supplied in predetermined lengths, e.g. of 1, 5, 10, 25 cm. Of course, it is not absolutely necessary that the edges of the plate 1 are completely covered by rails.

Although the invention has been described above primarily in connection with the fastening of painting canvas for paintings prior to the framing thereof, it is evident that the invention may be applied in the most different areas of the technics, such as in respect of bed-frames, mosquito windows, and so on.

The embodiments described above and illustrated in the drawings are, of course, to be regarded merely as non-limiting examples and may as to their details be modified in several ways within the scope of the following claims. Thus, the rails according to the invention may also be adapted to frames having a contour which is arcuate, at least in part. In this case each flange of the rail is comprised of substantially a series of triangular projections 12 and 13 having their bases located in the area of the arcuate web of the U-rail, these projections being separated by similar, alternating, triangular notches or recesses 14. Furthermore, other embodiments, which are also within the scope of the invention, may be created by combining features taken from different ones of the preceding exemplificatory embodiments.

What I claim is:

1. A profile rail used in securing a flexible sheet-like structure onto a substantially flat carrier having edges, said profile rail being U-shaped in cross-section and defined by a pair of flanges and a substantially flat web having opposite edges with a said edge connected to a said flange along a line, said profile rail being detachably secured to said carrier by said flanges with said flanges resiliently clamping an edge of said carrier with said flat web embracing an edge of said carrier, and a plurality of teeth disposed along said line extending longitudinally of said rail outwardly from said flat web adjacent one of said flanges, said one of said flanges being narrower than the other of said flanges so that said teeth may penetrate said sheet-like structure in a direction opposing tension applied of said teeth by said sheet-like structure.

2. A profile rail according to claim 1, wherein the rail is made of flexible sheet metal and said teeth are punched out and bent out of said sheet metal.

3. A profile rail according to claim 1, wherein said rail is made in one piece of plastic.

4. A profile rail according to claim 1, wherein said rail is cut at an acute angle, preferably of 45°, to the longitudinal axis of the rail, at at least one end.

5. A profile rail according to claim 1, wherein said rail constitutes a one-piece corner rail having two teeth rows extending substantially perpendicularly to each other.

6. A profile rail according to claim 5, wherein those two flanges of the rail which are located on one and the same side of the central plane of the rail are united into a substantially triangular flange.

7. The rail and carrier as claimed in claim 1 wherein a flexible sheet-like cover is affixed to said flat carrier by being penetrated and gripped by said teeth of said rail.

* * * * *